United States Patent [19]

Lam

[11] Patent Number: 4,798,996

[45] Date of Patent: Jan. 17, 1989

[54] ELECTRONIC PHOTOFLASH CONTROL CIRCUIT

[76] Inventor: Sheir C. Lam, Tung Lung House 935, Tai Hang Tung Road, Kowloon, Hong Kong, Hong Kong

[21] Appl. No.: 692,883

[22] PCT Filed: Jun. 1, 1984

[86] PCT No.: PCT/GB84/00191

§ 371 Date: Jan. 16, 1985

§ 102(e) Date: Jan. 16, 1985

[87] PCT Pub. No.: WO84/04866

PCT Pub. Date: Dec. 6, 1984

[30] Foreign Application Priority Data

Jun. 1, 1983 [GB] United Kingdom ..... 8315019

[51] Int. Cl.[4] ..... H05B 37/00

[52] U.S. Cl. ..... 315/241 P; 315/151; 315/159; 354/417

[58] Field of Search ..... 315/241 P, 242, 238, 315/159, 157, 151; 354/417, 145.1

[56] References Cited

U.S. PATENT DOCUMENTS

| | | | |
|---|---|---|---|
| 3,875,471 | 4/1975 | Buck | 315/157 X |
| 3,974,419 | 8/1976 | Adams, Jr. et al. | 315/241 P |
| 4,092,565 | 5/1978 | Neal | 315/242 X |
| 4,132,923 | 1/1979 | Gahler et al. | 315/159 X |
| 4,288,722 | 9/1981 | Ikawa | 315/241 P X |

OTHER PUBLICATIONS

Macek, "Einige Anwendungen Schneller Thyristoren", *Siemens-Bautelle-Informationen,* vol. 10, No. 5, 1972 Munich, FRG.

*Primary Examiner*—David K. Moore

*Attorney, Agent, or Firm*—Pollock, Vande Sande & Priddy

[57] ABSTRACT

A control circuit for a photoflash gun capable of fast recycling times, including a flashtube (FT), a switching circuit (SW, L1) for initiating operation of the flashtube, a switch (CR1) in series with the flashtube and switched on at the same time as the flashtube to permit current flow through it, and an arrangement for resetting the switch (CR1) after a predetermined time to cut off current flow through the flashtube. The arrangement comprises an inductance (L2) and a capacitor (C2) coupled to the anode of the switch (CR1), so that when the flashtube is switched on, current discharges through the capacitor (C2), creating a back EMF in the inductance (L2). A voltage of negative polarity is thus developed across capacitor (C2) to switch off switch (CR1) after a predetermined time, thereby to switch off the flashtube. The switch off time is controlled by a light calculation circuit responsive to ambient light.

13 Claims, 3 Drawing Sheets

ELECTRONIC PHOTOFLASH CONTROL CIRCUIT

TECHNICAL FIELD

The present invention relates to a control circuit for an electronic photoflash apparatus used in photographic applications.

BACKGROUND ART

Electronic photoflash guns have been extensively used for some years to provide extra illumination for photography in low ambient light conditions. A requirement of control circuits associated with photoflash guns has been to time accurately the firing of the photoflash tube(s) and also to provide a definite cut-off or quench of the photoflash tube when sufficient light has been generated. This latter cut-off can be either fixed to provide one or more discrete levels of generated light (whereupon exposure settings within the camera may need to be varied to compensate) or may be automatically provided when a quantity of light sufficient for a predetermined exposure setting of the camera has been generated by the tube.

Prior control circuits for photoflash guns as will hereinafter be described operate on the principle of charging and discharging capacitors in order to switch thyristors in order to initially fire the flash gun and to cut off or quench the flash gun. However, operation by charging and discharging capacitors can be slow, particularly where fast recycling times are required, for example in motor driven cameras where it may be necessary to take sequential exposures very rapidly and a photoflash gun must be able to recycle in a very short time between exposures.

SUMMARY OF THE INVENTION

It is therefore an object of the present invention to provide a control circuit for a photoflash gun which is capable of fast recycling times.

The present invention provides a control circuit for a photoflash gun, the circuit including a flashtube, a switching circuit for initiating operation of the flashtube, a switch means coupled with the flashtube which when operated permits current flow through the flashtube, and reset means for resetting the switch means after a predetermined time to cut off current flow through the flashtube. The reset means includes an inductance and a charge storage means coupled to the switch means such that when the switch means is operated current flow occurs through said charge storage means and said inductance to create a voltage across said charge storage means which is of a polarity such as to reset the switch means.

In accordance with the invention, the inductance and the charge storage means provide a resonant like circuit which permits fast recycling time of operation.

BRIEF DESCRIPTION OF DRAWINGS

Features and advantages of the present invention will become apparent from the following description of a prior arrangement and preferred embodiment of the invention, together with the accompanying drawings. in which.

DESCRIPTION OF PREFERRED EMBODIMENT

Referring to Figue 1, a previously-proposed circuit includes a voltage source 10 arranged to charge an energy storage capacitor CM (and other capacitors elsewhere in the circuit) to a voltage V1. Also connected across the storage capacitor CM are a series combination of energizing switch SW and resistor R1, and a capacitor C1 with triggering coil L1 also connected across switch SW. A secondary of the triggering coil L1 triggers a flash tube FT which is also connected to electronic switch circuit 11 for controlling cut-off of the flash tube FT. The switch circuit 11 is responsive to a light-sensing calculation circuit 12 which is connected to a light sensor LS.

The operation of the FIG. 1 circuit is broadly as follows. When the switch SW is closed (this switch being generally provided in the camera in association with the shutter), the trigger coil L1 generates a pulse signal by virtue of the previously-charged capacitor C1 discharging through the switch SW and coil L1, the pulse signal firing the flash tube FT. The light-sensing circuit 12 calculates when sufficient light has been emitted by the photoflash and provides a quenching signal at terminal C which turns off the switch circuit 11 and hence the flash tube FT.

Figure 1:
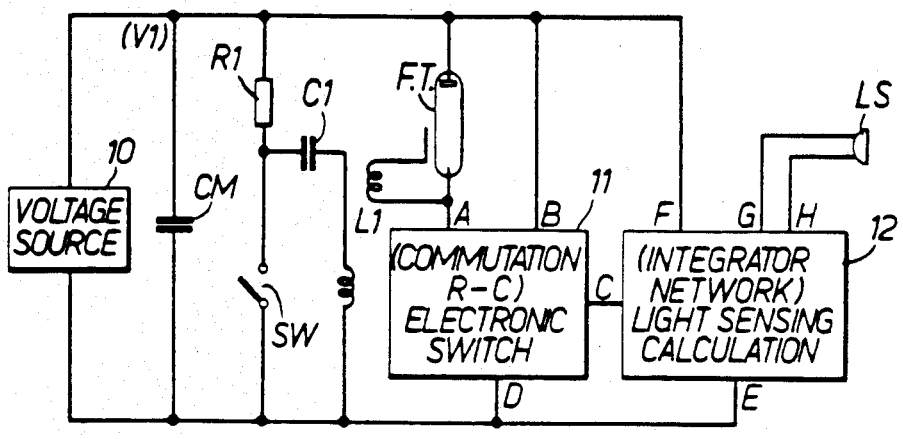
FIG. 1 is a basic block diagram of a prior art control circuit.
Figure 1A:
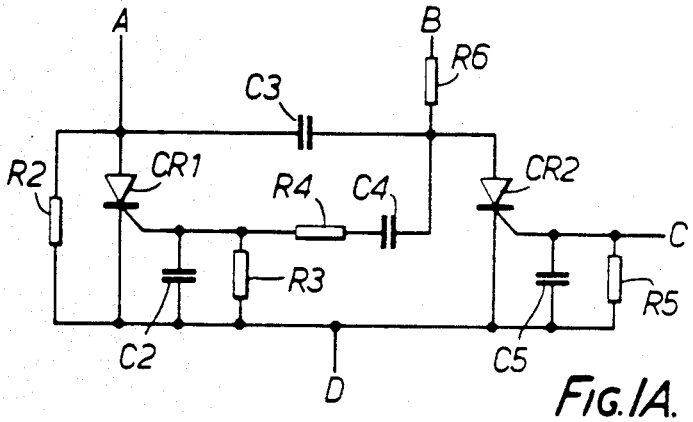
FIG. 1A shows the electronic switch circuit of FIG. 1 in greater detail.

Referring to FIG. 1A for a more detailed explanation of the operation of the switch circuit 11, initially capacitor C3 is charged by voltage source 10. When switch SW is closed and the flash tube triggered, thyristor switch CR1 is turned on by current flow through capacitors C3, C4 and resistor R4 which in turn provides a current path for the flash tube FT which emits light. When sufficient light has been emitted, the quenching signal at terminal C turns on the thyristor switch CR2. The effect of this is that the junction between capacitor C3 and resistor R6, which had previously been held at some positive voltage by virtue of the state of charge of capacitor C3, is clamped to zero volts (via the switch CR2) and the other side of capacitor C3 is left at a negative potential. This turns off switch CR1 and stops the flash tube FT emitting further light.

Figure 1B:
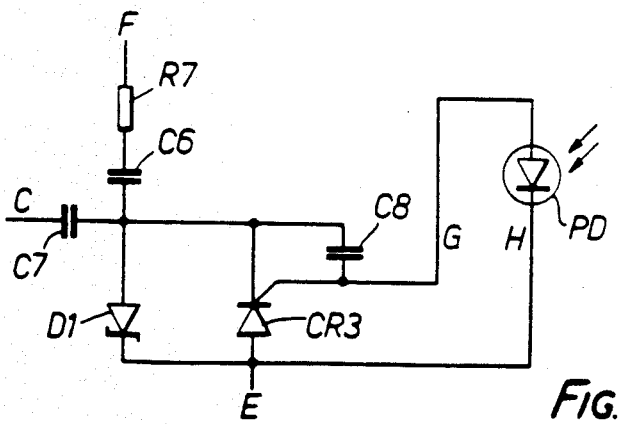
FIG. 1B shows the light-sensing calculation circuit of FIG. 1 in greater detail.

FIG. 1B will next be referred to in explanation of the generation of the quenching signal at terminal C. The circuit acts to integrate the light-responsive signal produced by a photodiode PD acting as photosensor. Initially, capacitor C6 is charged but, during the duration of light emission by the flash tube FT, the capacitor C6 is discharged via resistor R7, flash tube FT and switch CR1. When the photodiode PD has received the required quantity of light, this will have effectively been integrated by the capacitor C8 to a sufficient level to switch on the thyristor CR3 and generate the quenching signal (via capacitor C7) on terminal C. This then acts to turn on thyristor CR2 as previously discussed with reference to FIG. 14.

The means by which the flash tube of the preferred embodiment of the present invention is turned off differs in principle from that previously described, and provides an accurate and reproducible method of switching. This method relies on inductive resonant charging of a capacitor within the switching timing circuit to produce an opposite polarity voltage used to turn off the thyristor, rather than the clamping of an already-charged capacitor as previously described.

Figure 2:
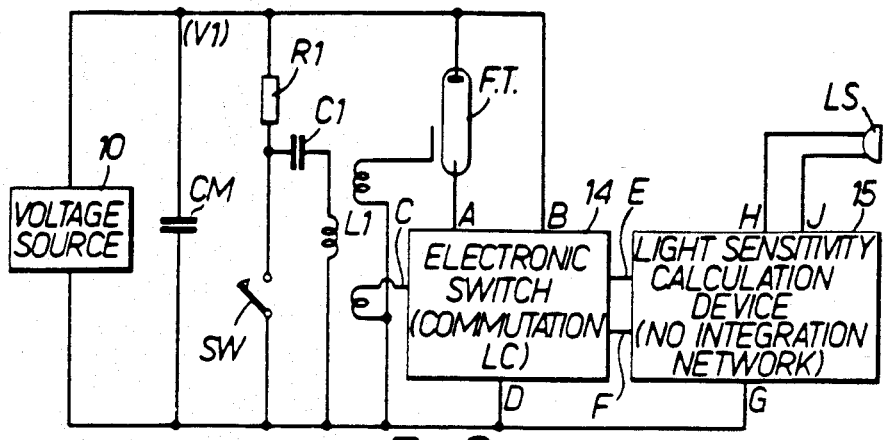
FIG. 2 is a block diagram of the preferred embodiment of the invention.
Figure 2A:
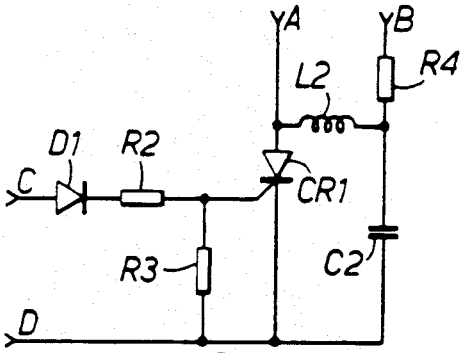
FIGS. 2A and 2B show two forms of electornic switch circuit which can be used in the circuit of FIG. 2.
Figure 2B:
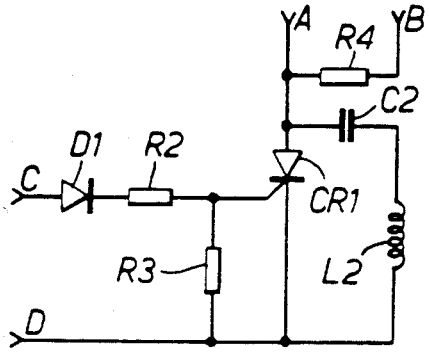

The circuit of FIG. 2 is similar to that of FIG. 1 with the exception that there are two connections E, F between the electronic switch circuit 14 and the light-sensing circuit 15, and a further winding from the trigger coil L1 to the switch circuit 14. FIGS. 2A and 2B show two broadly similar forms of switch circuit 14, but in this case there is no automatic light sensing by a circuit such as the calculator 15, and turn-off of the flash tube is achieved a predetermined time after turn-on, i.e., a set quantity of light will be emitted, and the camera will need to be adjusted in response of exposure settings dependent on the distance of the subject from the camera, etc.

Referring to FIGS. 2A and 2B (in association with FIG. 2) capacitors CM, C1 and C2 are charged when power is applied to the circuit from voltage source 10. When the switch SW is closed, charge in the capacitor C1 is discharged via the triggering coil L1 which provides a triggering pulse to the flash tube FT and also to the switch circuit at terminal C. The pulse at terminal C triggers thyristor CR1 (via diode D1 and resistor R2) and accordingly current flows through the flash tube FT which emits light by discharge of the main capacitor CM. In addition, charge from capacitor C2 flows through coil L2 and thyristor CR1 and the back e.m.f. in coil L2 generates inductive resonant charging of capacitor C2, with the current phase reversed by 180°. In other words, as shown in FIGS. 2A and 2B, the capacitor C2 would initially have been charged positively and, upon discharge via coil L2, would then have b come charged to a negative potential. This negative potential is applied to the anode of thyristor CR1 which causes the thyristor to turn off. Therefore the time during which the flash tube FT is emitting light is defined by the component values in the circuit, particularly the time constant of the LC circuit including capacitor C2 and coil L2.

Figure 2C:
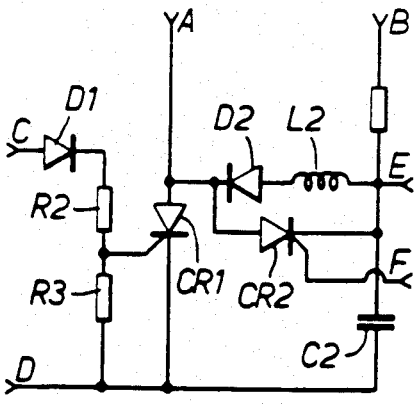
FIGS. 2C and 2D show two further developed forms of electronic switch circuit which can be used in the circuit of FIG. 2.
Figure 2D:
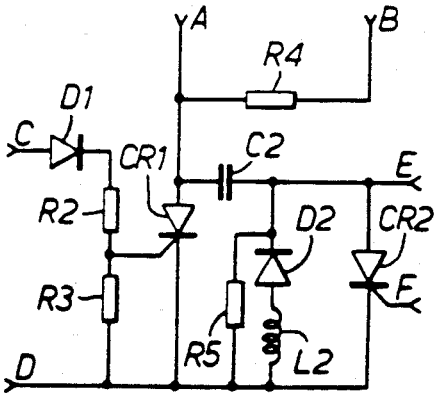

FIGS. 2C and 2D show two further switch circuits which operate in a somewhat similar manner to those of FIGS. 2A and 2B but include automatic flash quenching by the light sensing circuit 15. Turn-on of thyristor CR1 and consequent light emission from flash tube FT occurs exactly as previously described; however, when capacitor C2 has become charged to a negative potential by inductive resonant charging, it cannot apply that negative potential to the anode of thyristor CR1 because of the blocking action of diode D2. On the other hand, when a quenching signal is provided on terminal F (from the light sensing circuit 15), the thyristor CR2 is turned on allowing the reverse-phase current (at negative potential) to be applied to the anode of thyristor CR1, turning it off and hence stopping illumination of the flash tube FT. It will be seen that in all of the circuits of FIGS. 2A–2D, the negative potential which turns off thyristor CR1 is caused by the inductive resonant effect which reverse charges the capcitor C2. This is in distinction to the previously proposed circuits (e.g., as shown in FIG. 1A) where a negative potential is obtained by clamping or pulling down the potential of one terminal of a previously-charged capacitor so as to leave it with an effectively opposite charge on the other terminal.

Figure 2E:
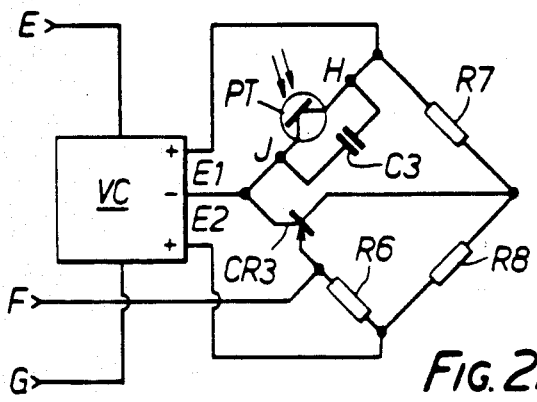
FIGS. 2E and 2F show two forms of light-sensing calculation circuit which can be used in the circuit of FIG. 2.
Figure 2F:
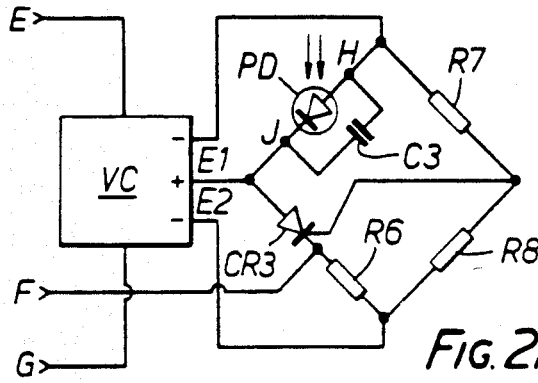

FIGS. 2E and 2F show two forms of light sensing circuit (15 in FIG. 2) which utilize bridge arrangements rather than the integrating circuit of the previously proposed device. The illustrated circuits derive power from the charge across capcitor C2 (in FIGS. 2C and 2D) fed via terminal E to voltage controller VC providing two potentials E1 and E2. A capacitor C3 connected across the light sensor LS (phototransistor PT in FIG. 2E and photodiode PD in FIG. 2F) is charged by the potential E1. The potential E2 is supplied to an amplifier circuit which comprises a suitable amplifying element CR3, such as a transistor, thyristor or unijunction transistor, and is compared to the potential E1. When the circuit is in balance, no signal is provided on terminal F.

When the appropriate light sensor receives a variation in light, the capacitor C3 discharges current in accordance with that variation. The circuit goes out of balance, triggering the amplifier circuit and generating a quench signal at terminal F (which acts as previously described to stop illumination of the flash tube FT).

In the circuits of FIGS. 2E and 2F, the potentials E1 and E2 are supplied from that on capacitor C2 (via terminal E) and are hence subject to the same phase reversal of 180°.

Figure 2G:
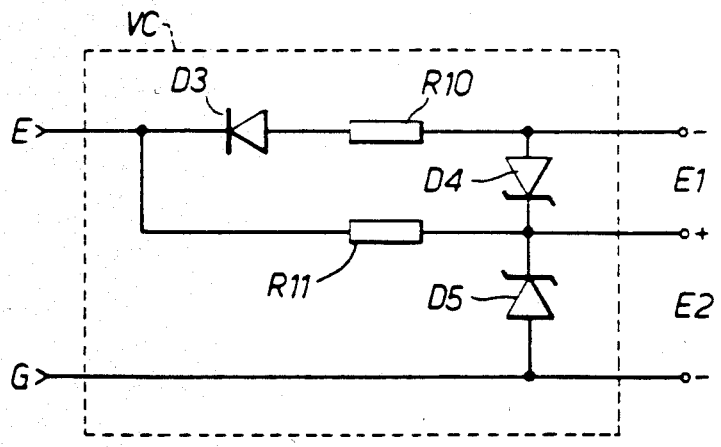
FIG. 2G shows a voltage controller circuit which can be used in the circuit of FIG. 2F.

FIG. 2G shows one form of voltage controller VC usable in the circuit of FIG. 2F. A similar controller could be used in the circuit of FIG. 2E but with the polarity-sensitive components (e.g., diodes) reversed. Referring to FIG. 2G, the two potentials E1 and E2 are derived from two series-connected zener diodes D4, D5 fed via resistors R10, R11 and a blocking diode D3 from the potential on capacitor C2 (FIG. 2D) via the terminal E.

In operation, when the thyristor CR1 turns on, inductive resonant charging caused by the back e.m.f. in coil L2 (as previously described) occurs in capacitor C2, with the current phase reversed by 180°. As a result of this, the voltage at terminal E goes initially negative, then rises along a charging curve via zero to a positive potential. At the negative impulse, a current path exists through voltage controller VC via zener diodes D5, D4 resistor R10 and diode D3. Thus the potential E1 is generated across zener diode D4 which charges capacitor C3, the potential remaining stored across capacitor C3 even when the negative impulse has ceased. Once the voltage at terminal E goes positive, a current path exists via resistor R11 and zener diode D5, and the potential E2 is provided across zener diode D5.

Referring back to FIG. 2F, when the light sensitivity calculation circuit is in balance, i.e., when the potentials E1 and E2 are equal, there is no potential across resistor R8. When the light sensing element PD receives a variation in light causing a change in its internal resistance or causig it to generate a current (as in the case of a solar cell), the capacitor C3 is discharged either by the change in resistance or by the generated current, in accordance with the variation in intensity of the light, thereby lowering the potential E1. Potential E2 is thus higher than potential E1 and the circuit goes out of balance. When the difference in potentials between E1 and E2 reaches a predetermined value causing resistor R8 to have a potential thereacross, thyristor CR3 is triggered and a quench signal is generated at terminal F acting to turn on thyristor CR2, as previously discussed.

The advantages of the above-described arrangements are that adjustable and extremely fast recycling times are provided for firing and cut-off of the photoflash tube. Thus such arrangements are very useful in association with motor driven cameras where it is otherwise possible to take sequential exposures very rapidly and a photoflash gun must be able to recycle in a very short time, between exposures. With the previously described circuits, the recycling times can be made sufficiently short to provide extra illumination for movie cameras which may require the photoflash tube to be fired more than twenty times per second.

I claim:

1. A control circuit for a photoflash gun, the circuit including a flash tube, a switch means in series connection with the flash tube, a switching circuit coupled to the flash tube and the switch means for initiating operation of the flash tube and turning on the switch means to permit current flow through the flash tube, the circuit comprising:

means for determining termination of the flash tube operation, the termination determining means including a resonant circuit having a capacitance and an inductance, the circuit being responsive to the initiation of the flash tube operation for causing current to flow through the inductance thereby developing a back emf, the back emf in turn producing a reverse voltage across the capacitance which is of a polarity such as to be able to reset the switch means; and means for applying the reverse voltage at a desired time to the switch means for turning off the switch means, thereby terminating the flash tube operation.

2. A control circuit as claimed in claim 1, wherein the switch means (CR1) comprises a thyristor with the control electrode connected to (said switch circuit) and with said storage means (C2) connected to the anode of said thyristor.

3. A control circuit as claimed in claim 1, comprising a rectifier means (D2) to permit current flow through said inductance and charge storage means until said charge storage means develops a voltage of said polarity whereupon said current flow ceases, and a switch (CR2) which is operative after a predetermined time to permit the voltage across the charge storage means to be operative to reset the switch means (CR1).

4. A control circuit according to claim 3, wherein said diode is connected in series with said inductance and said switch is connected in parallel with said inductance and diode.

5. A control circuit as claimed in claim 3, wherein a control electrode of said switch is connected to a light calculation device (PT,C3,CR3)(for operation thereof of the latter.)

6. A control circuit as claimed in claim 5, wherein said light calculation device comprises a light sensor (PT) coupled to a second charge storage means (C3), means for comparing the voltage developed across said second charge storage means with a further voltage (C3,R6–R8,CR3), and for providing a signal to operate said switch when the further voltage and the voltage across said second charge storage means have a predetermined relationship to one another.

7. A control circuit as claimed in claim 6, wherein said comparing means comprises a bridge circuit with said second charge storage means and said light sensor forming a first arm of said bridge, and said further voltage is developed across a second arm of said bridge in which a further switch (CR3) is disposed, said further switch being controlled by the voltage which is developed across a third arm of said bridge (R8).

8. A control circuit according to claim 7, wherein third and fourth arms of the bridge comprise respective impedances (R7, R8), said first arm is connected between said second arm and said third arm, said second arm is connected between said first arm and said fourth arm, and the connection point between said third and fourth arms is coupled to the control electrode of said further switch.

9. A control circuit according to claim 6, comprising means (D3,D4,D5) coupled to said first mentioned charge storage means for providing a voltage to said second charge storage means when the voltage across said first mentioned charge storage means is of a first polarity, and for providing a voltage to said comparing means when the voltage across said first mentioned charge storage means is of a second polarity.

10. A control circuit according to claim 9, wherein said voltage providing means is connected across said first mentioned charge storage means and includes a diode (D3) and a first zener diode (D4) connected between said second charge storage means and a nodal point, and a second zener diode (D5) coupled between said voltage comparison means and said nodal point and poled in the opposite sense to said first zener diode.

11. A control circuit according to claim 1, wherein said means for applying the reverse voltage comprises a connection between the resonant circuit and the switch means in order to apply the reverse voltage to the switch means to switch off the switch means at the instant the reverse voltage has risen to a sufficiently large value.

12. A control circuit according to claim 1, including a switching arrangement coupling the resonant circuit to the switch means and a light calculation device for determining when a sufficient amount of light has been emitted by the flash tube, the light calculation device being coupled to said switching arrangement for providing a signal thereto for operating the switching arrangement to permit said reverse voltage to be applied to the switch means.

13. A control circuit as claimed in claim 12, wherein the switching arrangement comprises a diode connected normally to block application of the reverse voltage to the switch means, and a second switch means responsive to the signal from the light calculation device for reversing the voltage across the diode to permit application of the reverse voltage to the switch means.

* * * * *